US005690534A

United States Patent [19]

Shea

[11] Patent Number: 5,690,534

[45] Date of Patent: Nov. 25, 1997

[54] BIRD AND ANIMAL CALL

[76] Inventor: William M. Shea, 13131 Keystone Ave. North, Hugo, Minn. 55038

[21] Appl. No.: 576,501

[22] Filed: Dec. 21, 1995

[51] Int. Cl.[6] ..... A63H 5/00

[52] U.S. Cl. ..... 446/205; 446/206; 84/386

[58] Field of Search ..... 446/205, 206, 446/204, 216, 208; 116/140, 137; 84/386, 380 C, 384, 380 R

[56] References Cited

U.S. PATENT DOCUMENTS

| | | | |
|---|---|---|---|
| D. 56,986 | 1/1921 | Mortensen et al. . | |
| 174,845 | 3/1876 | Park | 84/380 C X |
| 388,439 | 8/1888 | Olney | 446/205 |
| 500,433 | 6/1893 | Schubert | 446/205 X |
| 583,077 | 5/1897 | Oliveri | 84/386 |
| 603,555 | 5/1898 | Davis | 446/205 X |
| 1,094,006 | 4/1914 | O'Reilly | 446/204 |
| 2,006,274 | 6/1935 | Kushner | 446/206 X |
| 2,245,484 | 6/1941 | Leavens . | |
| 2,697,298 | 12/1954 | Bacon | 446/208 X |
| 2,737,757 | 3/1956 | Liebelt | 446/205 |
| 2,972,834 | 2/1961 | Bacon . | |
| 3,722,348 | 3/1973 | Visser | 84/380 C |
| 4,207,703 | 6/1980 | Saso | 446/205 |

OTHER PUBLICATIONS

The enclosed drawing of the "call" from The Country Mill, Inc., and the description thereof in the transmittal letter with this Information Disclosure Statement.

*Primary Examiner*—Mickey Yu
*Attorney, Agent, or Firm*—William L. Huebsch

[57] ABSTRACT

A wind instrument that can be used to replicate the calls of birds and animals particularly including the common loon. An instrument having the type of mouthpiece used on a recorder and an elongate body having a bore has an baffle within the bore that closes only a portion of the bore. With the baffle at at least one location in the bore, significant changes can be made in the pitch of the sound being made to replicate calls without movement of the baffle along the bore. The baffle can be fixed and the instrument used to replicate the wail of the common loon, or can be movable so that all of the primary calls of the common loon can be replicated.

15 Claims, 2 Drawing Sheets

BIRD AND ANIMAL CALL

TECHNICAL FIELD

The present invention relates to devices that can be used to replicate the calls of birds or animals, and in one particular aspect to wind instruments used to replicate the calls of the common loon.

BACKGROUND ART

Many devices have been devised that can be used to replicate the calls of birds, certain of which have been adapted to replicate the calls of the common loon. Heretofore, however, known devices are either too difficult for an average person to operate, or the sound produced by the devices is not a very accurate replication of the calls of the common loon, or the devices are limited in the types of loon calls they can make.

DISCLOSURE OF THE INVENTION

The present invention provides a device or wind instrument that can be used to replicate the calls of birds, particularly including the common loon, that is very easy for an average person to operate, and can produce calls that fairly accurately replicate the primary calls of the common loon (gavia immer).

The wind instrument according to the present invention comprises an elongate body having a bore with opposite axially spaced inlet and outlet ends; and a mouthpiece at the inlet end of the bore. The mouthpiece has a through windway smaller than the bore with an inlet at the end of the mouthpiece opposite the bore and an outlet communicating with the inlet end of the bore adjacent the inner surface of the body. The body has at least one window surface defining an opening or window between the inner and outer surfaces of the body and aligned with the outlet of the windway. The window surface intersects the inner surface to define a sharp edge at the side of the window opposite the mouthpiece so that air blown through the windway into the bore and the window will produce sound. A baffle within the bore closes only a portion of the bore so that with the baffle at at least one location in the bore, significant changes can be made in the pitch of the sound being made to replicate at least one of the calls of the common loon (i.e., the wail) that requires a significant jump in sound frequency (e.g., from about 800 to about 1090 cycles per second) without movement of the baffle axially along the bore.

Good results have been obtained when the baffle is cylindrical in cross section, closes between about 87 to 97 percent and preferably about 92 percent of the bore, and is up to about 0.83 inch or 2.11 centimeter long and preferably about 0.38 inch or 0.97 centimeter long axially of the body.

The baffle can be fixed at a position in the bore that affords significant changing of the pitch of the sound being made in response to different air pressures blown through the instrument to replicate at least one of the calls of the common loon.

Preferably, however, the baffle is not fixed in the bore, and the instrument includes an elongate rod significantly smaller in cross sectional area than the baffle that has an attached end attached to the baffle, and an axial length such that the elongate rod projects from the baffle through the outlet end of the bore and has indicia spaced along the length of the rod to indicate, when the indicia is aligned at the outlet end of the bore, positions of the baffle within the bore that can be used in replicating most of the primary calls of the common loon. Using such indicia (or instinctively after the use of the instrument is mastered) a user can replicate common loon calls including (1) three types of the wail, a call used by common loons to interact with other common loons, locate a lost chick or mate two of which require a significant change in pitch to reproduce; (2) the tremolo also referred to as the laugh that is a multi purpose call and can indicate alarm, annoyance or greeting which requires a change in pitch to reproduce; (3) the yodel, which is a signature call made only by males and is an aggressive call used during border disputes and to maintain territory which requires many significant changes in pitch to reproduce; (4) the hoot which adult common loons use to maintain contact with chicks or family groups which is done at different pitches; and (5) the chick by which young common loons communicate that is done at a high pitch.

The body can also have a through cord opening at a location spaced from the outlet end of the bore a distance less than the minimum distance from the outlet end of the bore that the baffle is placed in replicating the calls of the common loon, and the instrument can include a flexible cord having a portion extending through and filling the cord opening and then extending out of the outlet end of the bore so that the cord portion within the bore acts as a stop to prevent movement of the baffle past the cord portion and out of the outlet end of the bore.

Also, the outer surface of the body can be cylindrical, the body can be formed of an off white colored polymeric material, and the cylindrical outer surface can be printed with black markings to replicate the appearance of birch bark to provide a very woodsy and pleasing appearance for the instrument.

BRIEF DESCRIPTION OF THE DRAWING

The present invention will be further described with reference to the accompanying drawing wherein like reference numerals refer to like parts in the several views, and wherein.

DETAILED DESCRIPTION OF THE EMBODIMENTS

Figure 1:
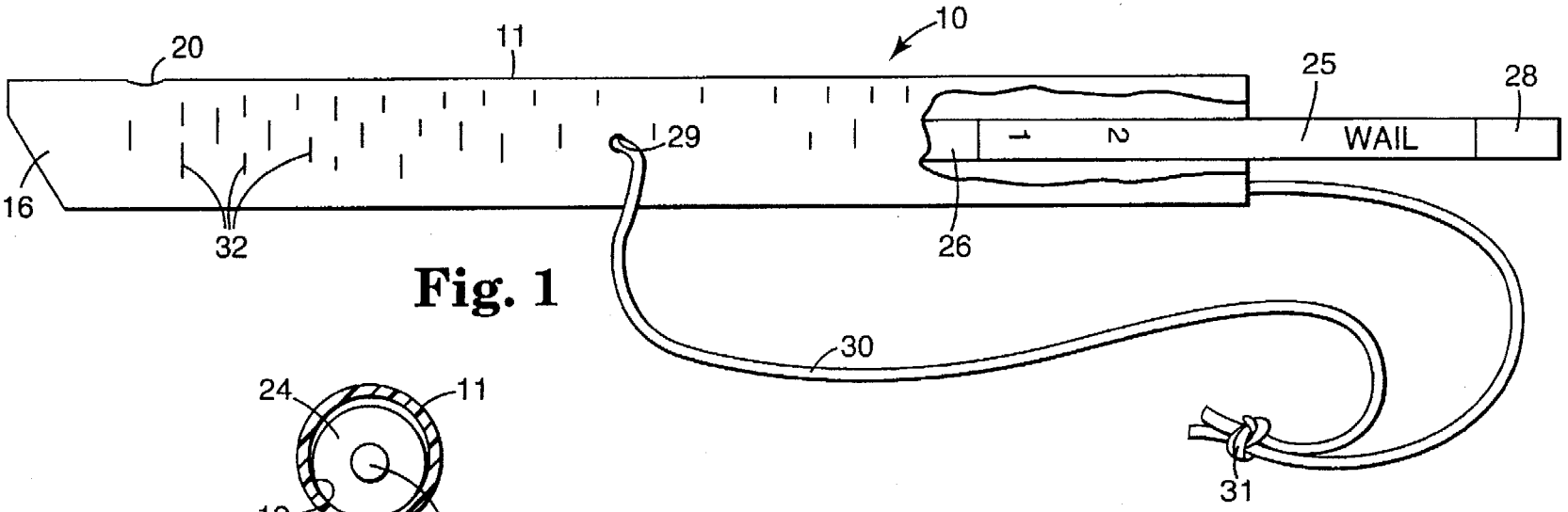
FIG. 1 is a side view of a first embodiment of a wind instrument or loon call according to the present invention having a part broken away to show detail.
Figure 3:
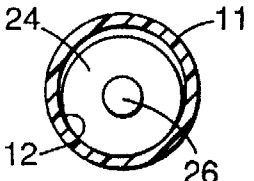
FIG. 3 is a cross sectional view taken approximately along lines 3—3 of FIG. 1.
Figure 2:
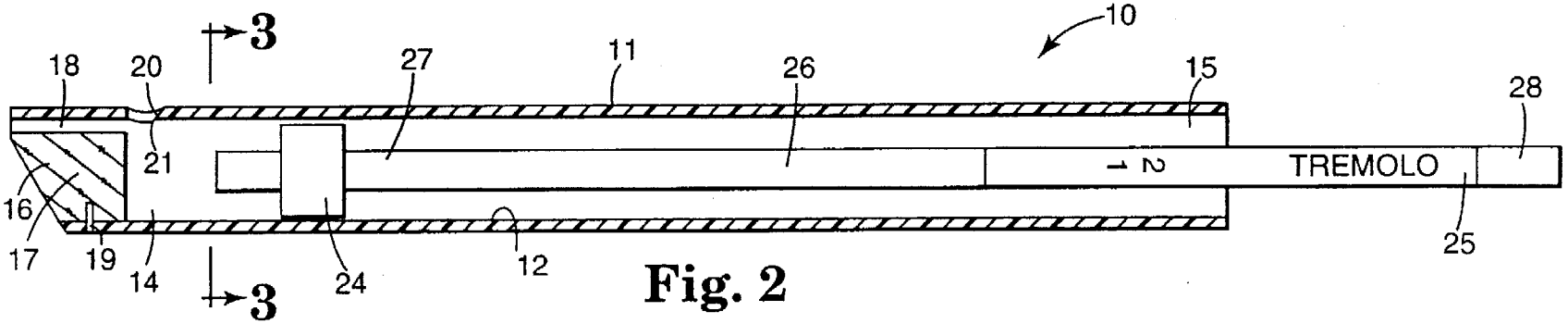
FIG. 2 is a longitudinal sectional view of the loon call of FIG. 1.
Figure 4:
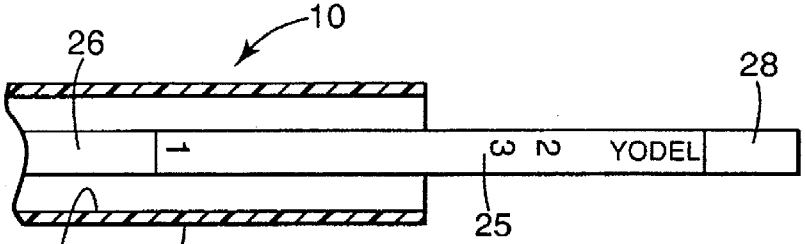
FIGS. 4 and 5 are fragmentary views illustrating indicia applied to the end portion of a rod included in the loon call of FIG. 1.
Figure 5:
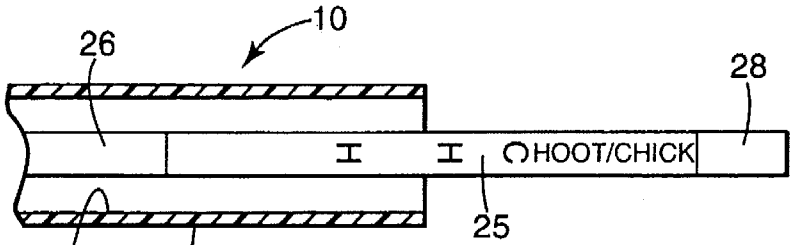

Referring now to FIGS. 1 through 5 there is illustrated a first embodiment of a wind instrument according to the present invention that can be used to replicate the calls of birds or animals particularly including the calls of the common loon, which instrument is identified by the reference numeral 10.

Generally, the instrument 10 comprises an elongate cylindrical tubular body 11 (e.g., of polymeric material, wood, ceramic, or metal). The body 11 has a cylindrical inner surface defining a bore 12 having an axis and opposite axially spaced inlet and outlet ends 14 and 15. A mouthpiece 16 is formed by a plug or fipple 17 (e.g., of polymeric material or wood) fixed in an end part of the body 11 by a pin 19. The mouthpiece 16 is positioned at the inlet end 14 of the bore 12. The mouthpiece 16 has a through passage or windway 18 that is smaller than the bore 12. The windway 18 has an inlet at the end of the mouthpiece 16 opposite the bore 12 and an outlet communicating with the inlet end 14 of the bore 12 adjacent the inner surface of the body 11. The body 11 has generally rectangularly disposed surfaces defining a through opening or window between the inner and the outer surfaces of the body 11 that is aligned with the outlet of the windway 18. Those surfaces defining the window include a window surface 20 intersecting the inner surface of the body 11 at an angle (e.g., about 45 degrees) that defines a Sharp edge 21 at the side of the window opposite the mouthpiece 16 so that air blown through the windway 18 into the bore 12 and the window will produce sound. Such sound is said to be produced by most of the air going first over the edge 21, then under the edge 21, then over the edge 21, then under the edge 21, etc., with the switching of the air being extraordinarily rapid (i.e., happening hundreds, even thousands of times each second) and the air turbulence that results from such switching forming sound that is modified and amplified by the bore 12.

The portion of the instrument 10 described in the preceding paragraph generally has a known conventional structure that is used in whistles, recorders, and other like instruments. The instrument 10 differs from such known instruments, however, in that it is free of through openings that are not filled (except for the window), and it includes a cylindrical baffle 24 within the bore 12 that closes only a portion of the bore 12 (e.g., between 87 to 97 percent and preferably about 92 percent of a 0.710 inch or 1.803 centimeters diameter bore 12) so that, with the baffle 24 at at least one location in the bore 12, significant changes can be made in the pitch of the sound being made to replicate at least one of the calls (i.e., the wail of the common loon) without movement of the baffle 24 axially along the bore 12.

The instrument includes an elongate cylindrical rod 26 much smaller in cross sectional area than the cylindrical baffle 24 (e.g., a rod diameter of 0.25 inch for a baffle diameter of 0.680 inch) having an attached end 27 extending coaxially through and attached to the baffle 24, and an axial length that exceeds the axial length of the bore 12. The elongate rod 26 projects from both sides of the baffle 24, with one portion extending toward the fipple 17 to establish the closest distance that the baffle can be spaced from the fipple 17 and edge 21, and the longer portion extending through the outlet end of the bore 12 which is also the end of the body 11. The rod 26 has indicia (later to be explained) spaced along its length that indicate, when visually aligned by the user at the outlet end of the bore 12 or end of the body 11, positions of the baffle 24 within the bore 12 that can be used in replicating the primary calls of the common loon.

As an example, when the inner surface of the body 11 is 0.710 inch or 1.803 centimeter in diameter, the distance from the fipple 17 to the edge is about 0.18 inch or 0.457 centimeter, the cylindrical baffle 24 is about 0.38 inch or 0.97 centimeter long axially of the body 11 between its ends and has a diameter of 0.680 inch or 1.727 centimeter or a cross sectional area that is about 92 percent of the cross sectional area of the through opening 12, and the elongate rod 26 is 0.25 inch or 0.64 centimeter in diameter, the instrument 10 when properly blown will produce a tone of about 800 cycles per second when the adjacent end of the baffle 24 is spaced from the edge 21 of the window by about 2.55 inches or 6.48 centimeters. That tone will increase very little in frequency as the baffle 24 is moved from that position toward the mouthpiece 16 to a position with its adjacent end spaced about 2.24 inches or 5.69 centimeters from the edge 21 of the window, at about which position the tone will suddenly jump to about 1090 cycles per second. The tone will then increase generally linearly to about 1454 cycles per second as the baffle 24 is moved from that position to a position with its adjacent end spaced about 0.37 inch or 0.94 centimeter from the edge 21 of the window, at about which position the tone will again suddenly jump to about 2000 cycles per second (the frequencies given are approximate as it is difficult to measure them with great precision).

To facilitate replicating the various calls of the common loon, a paper plastic coated sheet 25 is adhered in a cylinder around the periphery of the rod 26 and is printed with lines dividing the periphery of the rod 26 into four longitudinally extending segments identified on their ends as "Wail", Tremolo", "Yodel" and Hoot/Chick, (see FIGS. 1, 2, 4 and 5 which illustrate the four sides of the sheet 25 around the rod 26). The sheet 25 is also printed with indicia axially aligned in each segment that, when generally aligned at the outlet end 15 of the bore 12 or end of the body 11, position the end of the baffle 24 adjacent the plug 17 within the bore 12 at different distances spaced from the edge 21 of the window so that the primary calls of the common loon can be replicated as indicated below. For "Wail" (see FIG. 1) that indicia is "1" and "2". The baffle 24 will be spaced from the edge 21 of the window by about 2.55 inches or 6.48 centimeters when "1" is aligned at the end of the body 11 and the baffle 24 will be spaced from the edge 21 of the window by about 2.24 inches or 5.69 centimeters when "2" is aligned at the end of the body 11. For "Tremolo" (see FIG. 2) that indicia is "1" and "2". The baffle 24 will be spaced from the edge 21 of the window by about 1.35 inches or 3.43 centimeters when "1" is aligned at the end of the body 11 and the baffle 24 will be spaced from the edge 21 of the window by about 1.5 inches or 3.8 centimeters when "2" is aligned at the end of the body 11. For "Yodel" (see FIG. 4) that indicia is "1", "3", and "2". The baffle 24 will be spaced from the edge 21 of the window by about 2.70 inches or 6.86 centimeters when "1" is aligned at the end of the body 11, the baffle 24 will be spaced from the edge 21 of the window by about 0.37 inch or 0.94 centimeter when "2" is aligned at the end of the body 11, and the baffle 24 will be spaced from the edge 21 of the window by about 0.65 inches or 1.65 centimeters when "3" is aligned at the end of the body 11. For "Hoot/Chick" (see FIG. 5) that indicia is "H", "H", and "C". The baffle 24 will be spaced from the edge 21 of the window by 0.88 inches or 2.24 centimeters when one "H" is aligned at the end of the body 11, the baffle 24 will be spaced from the edge 21 of the window by about 1.55 inches or 3.94 centimeters when the other "H" is aligned at the end of the body 11, and the baffle will be spaced from the edge 21 of the window by about 0.25 inches or 0.64 centimeters when "C" is aligned at the end of the body 11.

Using the instrument 10, the various calls of the common loon are made as follows:

Wail, type 1: The rod 26 is positioned with the wail indicia "1" (see FIG. 1) aligned at the end of the body 11 (i.e., alignment of the indicia with the end of the body 11 as used herein means that the indicia projects slightly from the end of the body 11 where it can be seen by the user). The user blows into the mouthpiece to produce a call of about 2 seconds duration using soft steady pressure similar to a sigh, and dropping off slightly at the end of the call. The resultant 2 second call or wail is at a frequency of about 800 cycles per second.

Wail, type 2: The rod 26 is initially positioned with the wail indicia "1" aligned at the end of the body 11. The user blows into the mouthpiece to produce a call of about 4 seconds duration using soft steady pressure similar to a sigh, and dropping off slightly at the end of the call. About halfway through the call the rod is moved to align the wail indicia "2" with the end of the body 11. The resultant 4 second call starts with a frequency of about 800 cycles per second and then jumps to a frequency of about 1090 cycles per second.

Wail, type 3: The rod 26 is initially positioned with the wail indicia "1" aligned at the end of the body 11. The user blows into the mouthpiece to produce a call of about 6 seconds duration using soft steady pressure similar to a sigh, and dropping off slightly at the end of the call. During the call the rod is first moved to align the wail indicia "2" with the end of the body 11 after about 2 seconds, and is then moved to again align the wail indicia "1" with the end of the body 11 after another 2 seconds. The resultant 6 second call or wail starts with a frequency of about 800 cycles per second, jumps to a frequency of about 1090 cycles per second, and then returns to a frequency of about 800 cycles per second.

Tremolo: The rod 26 is initially positioned with the tremolo indicia "1" (see FIG. 2) aligned at the end of the body 11. The user blows into the mouthpiece to produce a call of about 2 seconds duration using steady pressure. During the call the rod is moved rapidly or quivered to first move the tremolo indicia "2" into alignment with the end of the body 11, then again align the tremolo indicia "1" with the end of the body, then again align the tremolo indicia "2" with the end of the body 11, etc., for about 5 cycles, care being taken that the rod 26 is not moved more than ⅛ inch. The resultant 2 second call or tremolo cycles back and forth (but does not jump) between frequencies of about 1225 cycles per second and 1300 cycles per second. A similar tremolo call can be made using only 3 cycles.

Yodel: The rod 26 is initially positioned with yodel indicia "1" (see FIG. 4) aligned at the end of the body 11. The user blows into the mouthpiece 16 to produce a call part of about 2 seconds duration using soft steady gradually increasing pressure, and during the call part moves the rod to align yodel indicia "2" with the end of the body. The user then pauses for about ½ second, and then again blows into the mouthpiece to produce 3 to 6 spaced call parts of about 2 seconds each using high steady pressure while, during each call part, moving the rod to align yodel indicia "3" with the end of the body 11 and then moving the rod 26 to again align yodel indicia "2" with the end of the body 11. The first resultant call part starts with a frequency of about 800 cycles per second, which frequency is steady, then jumps to about 1090 cycles per second, then increases about linearly to about 1454 cycles per second as the rod 26 is moved toward alignment with yodel indicia "2," and then jumps to a frequency of about 2000 cycles per second as that indicia "2" is reached; whereas the subsequent call parts start with that frequency of about 2000 cycles per second, drop to a frequency of about 1350 cycles per second, and then again jump to a frequency of about 2000 cycles per second.

Hoot: The rod 26 is positioned with one of the hoot/chick indicia "H" or a portion of the rod between those indicia "H" aligned at the end of the body 11. The user blows into the mouthpiece to produce a call of about ½ second duration by emitting a short burst of air while moving his or her tongue as though saying "too". The rod 26 is not moved. The resultant call or hoot is at a single frequency in the range of about 1000 to 1400 cycles per second depending on the positioning of the rod 26.

Chick: The rod 26 is positioned with the hoot/chick indicia "C aligned at the end of the body 11. The user blows into the mouthpiece to produce a call of about ½ second duration by emitting a short burst of air while moving his or her tongue as though saying "too". The rod 26 is not moved. The resultant chick call is at a frequency somewhere in the range of about 1480 to 2000 cycles per second.

An advantage of the instrument 10 is that calls that involve producing sounds at different frequencies can be done by simply moving the rod 26 between the positions that make those sounds. There is no need to stop the call in order to reposition the rod 26 during different parts of the call because all of the parts of the primary calls of the common loon can be played by moving the rod 26 through adjacent positions.

The common loon calls made by the instrument 10 have been found to be close in frequency to calls actually made by common loons particularly considering that the calls made by various individual common loons vary somewhat from each other in frequency. From the reactions of common loons observed when the instrument is used, it appears that some common loons have believed that calls made by the instrument 10 were made by other common loons.

As illustrated, the body 11 has a through cord opening 29 at a location spaced from the outlet end 15 of the bore 12 a distance less than the minimum distance from the outlet end 15 of the bore 12 that the baffle 24 is placed in replicating the calls of the common loon. The instrument 10 includes a flexible strong woven cord 30 having a portion extending through the cord opening 29 and out of the outlet end 15 of the bore 12. The cord portion within the bore 12 acts as a stop to prevent movement of the baffle 24 past the cord portion and out of the outlet end 15 of the bore 12. End portions of the cord 30 are tied together in a knot 31 so that the cord 30 also provides a convenient means for hanging the instrument 10 around a users neck or from a hook for storage. The cord opening 29 is sized so that the cord 30 fills it completely, as any open space in the cord opening 29 around the cord 30 would affect the sound of the instrument 10.

The tubular body 11 is formed of an off white colored polymeric material (e.g., high impact plastic), and its cylindrical outer surface is printed with black variably spaced and sized transversely extending markings 32 to replicate the appearance of birch bark by using a known type of screen printer adapted to print the surfaces of cylindrical objects.

Many modifications may be made in the instrument 10. For example, it has been found that the baffle 24 can have an axial length between a minimum length that has sufficient structural strength to maintain its shape, to an axial length of over 0.83 inch or 2.1 centimeter. Above that length the instrument still works, but its sound seems to be degraded. Also, an axial length for the baffle 24 of about 0.38 inch or 0.97 centimeters seems to produce the best sound. In addition to the baffle 24 having a cylindrical cross section that doses only a portion of the bore 12 (e.g., between 87 to 97 percent and preferably about 92 percent of a 0.710 inch or 1.803 centimeter diameter bore 12), cross sections that close only that portion that have a through passageway or an axially extending notch on the edge of the baffle 24 that without the passageway or notch would fill the bore 12 have been found to produce the desired sound from the instrument. The windway 18 illustrated is larger at its inlet than at its outlet, and the window is rectangular which some believe to be the most effective configuration. For ease of manufacture, however, a good quality instrument can be made by making the windway 18 the same size from its inlet to its outlet, and forming the window with the end of a drill so that it is circular and has a single frusta conical window surface intersecting the inner surface of the body at an angle of about 45 degrees. The dimensions given above for the positions of the baffle 24 with respect to the edge 21 of the window were obtained on an instrument that had such a windway and circular window with the inner diameter of that window at the edge being about 0.2 inch or 0.5 centimeter. Also, it has been found that for the best sound, the bore 12 with an inner diameter of 0.710 inch or 1.803 centimeter should have a length of at least 5 inches or 12.7 centimeters, and preferably at least 8 inches or 20 centimeters. An instrument with a bore diameter of 0.800 inch or 2.032 centimeters has been tried and found to work satisfactorily. Bore diameters in the range of about 0.3 to 1.5 inch or 0.76 to 3.8 centimeters should be usable. Also, we believe that the bore 12 could have cross sections other than round, such as square, octagonal, etc., and still work in the manner described above.

Figure 6:
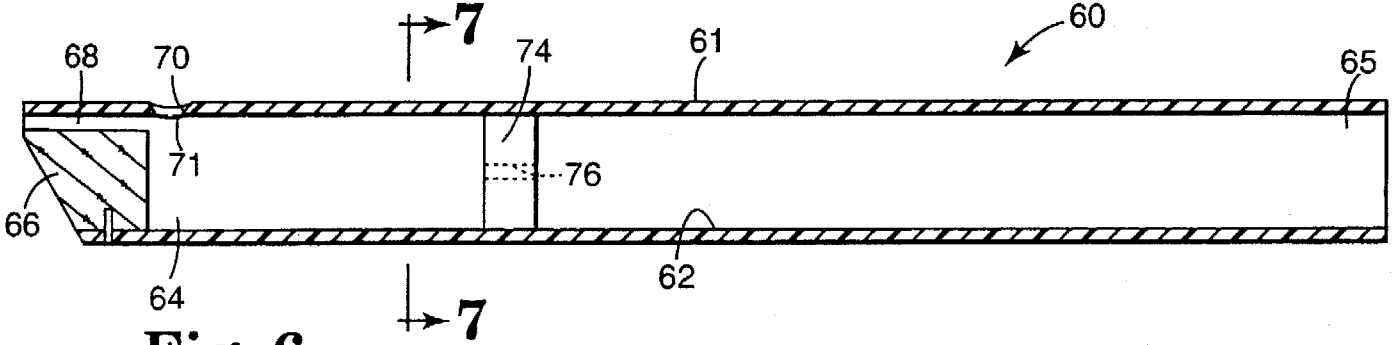
FIG. 6 is a longitudinal sectional view of a second embodiment of a wind instrument or loon call according to the present invention.
Figure 7:
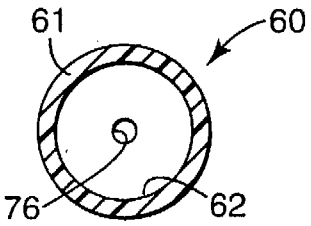
FIG. 7 is a cross sectional view taken approximately along lines 7—7 of FIG. 6.

Referring now to FIGS. 6 and 7 there is illustrated a second embodiment of a wind instrument according to the present invention that can be used to replicate the call of birds and animals particularly including the common loon, which instrument is generally identified by the reference numeral 60.

Generally, the instrument 60 comprises an elongate cylindrical tubular body 61 having a cylindrical inner surface defining a bore 62 having an axis and opposite axially spaced inlet and outlet ends 64 and 65. A mouthpiece 66 is positioned at the inlet end 64 of the bore 62, which mouthpiece 66 has a through windway 68 of a uniform cross sectional area that is smaller than the bore 62 and has an inlet at the end of the mouthpiece 66 opposite the bore 62 and an outlet communicating with the inlet end 64 of the bore 62 adjacent the inner surface of the body 61. The body 61 has a frusta conical window surface 70 defining a through opening or window aligned with the outlet of the windway 68. The window surface 70 intersects the inner surface of the body 61 to define a sharp edge 71 at the side of the window opposite the mouthpiece 66 so that air blown through the windway 68 into the bore 62 and the window will produce sound as described above. The instrument 60 includes a cylindrical baffle 74 within the bore 62 that has a central circular through bore 76 so that the baffle 74 closes only a portion of the bore 62 (e.g., 97 percent of a 0.71 inch or 1.803 centimeters diameter bore 62, which serves to make the types 1, 2 and 3 wail calls). The baffle 74 is positioned at a location in the bore 62 where significant changes can be made in the pitch of the sound being made by the instrument 60 by changing the pressure of air being blown into the instrument 60 to replicate the wail call of the common loon without movement of the baffle 74 axially along the bore 62. As an example, the wail can be replicated in that manner when the bore 62 has the dimensions of the bore 12 described above for the instrument 10, and the baffle 74 is fixed with its adjacent end about 1.79 inches or 4.55 centimeters from the edge 71.

The present invention has now been described with reference to two embodiments and several modifications thereof. It will be apparent to those skilled in the art that many changes can be made in the embodiments and modifications described without departing from the scope of the present invention. It may well be possible to use an instrument according to the present invention to replicate the calls of other birds (e.g., the calls of the morning dove or the sea gull) or animals (e.g., the bugling of elk) that include sudden jumps in frequency of the sound produced by the call. When the baffle 24 in the instrument 10 is spaced from the edge 21 of the window by about 0.28 inch or 0.71 centimeter (at which position the adjacent end of the rod 26 contacts the tipple 17) and a person blows extremely hard into the mouthpiece 16 of the instrument 10, the frequency produced will jump from about 2000 cycles per second to a frequency in the range of about 2500 to 2700 cycles per second, and produces a sound which is similar to the sound of a bugling elk. The baffle 74 in the instrument 60 could be fixed at such a distance, or the distance that produces such a sound in the instrument 60. Also, the tube 61 of the instrument 60 could be bent into the shape of a U to make it more compact and easy to carry in the field. Thus, the scope of the present invention should not be limited to the structures and methods described in this application, but only by the structures and methods described by the language of the claims and the equivalents thereof.

I claim:

1. A wind instrument for replicating the calls of birds or animals, said instrument comprising:

an elongate body having an outer surface, an inner surface defining a bore having an axis and opposite axially spaced inlet and outlet ends;

a mouthpiece at the inlet end of the body, said mouthpiece having a through windway smaller than said bore and having an inlet at the end of the mouthpiece opposite the bore and an outlet communicating with the bore at the inlet end of the bore adjacent the inner surface of the body;

said body having at least one window surface defining a window through said body between said outer and inner surfaces and aligned with the outlet of said windway, said window surface intersecting said inner surface to define a sharp edge at the side of the window opposite the mouthpiece so that air blown through the windway into the bore and the window will produce sound; and a baffle within said bore closing between 87 to 97 percent of the cross sectional area of said bore and being up to 0.83 inch or 2.11 centimeters long axially along said body, said baffle being movable axially along said bore between inner and outer positions relative to said mouthpiece, and said instrument including an elongate rod smaller in cross sectional area than said baffle having an attached end attached to said baffle and an opposite outer end, said elongate rod projecting from said baffle through the outlet end of said bore, so that with said baffle moved through at least one location in the bore, significant changes can be made in the pitch of the sound being made by blowing into the instrument with a generally steady air pressure to replicate the call.

2. An instrument according to claim 1 particularly adapted to replicate the call of the common loon wherein indicia are spaced along said rod to indicate, when generally aligned at the outlet end of said bore, positions of said baffle within said bore that can be used in replicating the primary calls of the common loon.

3. An instrument according to claim 2 wherein when air is blown into said instrument and said baffle is moved from said outer position to said inner position said instrument initially makes a sound that is initially at about 800 cycles per second, then jumps to about 1090 cycles per second, then increases generally linearly from about 1090 cycles per second to about 1454 cycles per second, and then jumps to about 2000 cycles per second.

4. An instrument according to claim 3 wherein when air is blown very hard into said instrument with said baffle at said inner position the sound made by said instrument again jumps from about 2000 cycles per second to a frequency in the range of about 2500 to 2700 cycles per second.

5. An instrument according to claim 1 particularly adapted to replicate the call of the common loon wherein the inner surface of said body is cylindrical, said baffle is cylindrical about an axis parallel to the axis of said body, has opposite axially spaced ends, is about 0.38 inch or 0.96 centimeter long between said ends, and has a cross sectional area that is about 92 percent of the cross sectional area of said bore, and said instrument includes indicia spaced along said rod to indicate, when aligned at the outlet end of said bore, positions of said baffle within said bore that can be used in replicating the primary calls of the common loon.

6. An instrument according to claim 5 wherein said inner surface of said body is cylindrical and has a diameter of about 0.71 inch or 1.8 centimeter, said bore has a length of at least 5 inches or 12.7 centimeters between said inlet and outlet ends, and said rod has indicia spaced along said rod that, when aligned at the outlet end of said bore, positions the adjacent end of the baffle within said bore at distances spaced about 2.24 and 0.37 inches or 5.69 and 0.94 centimeters from said edge at about which positions significant changes of the pitch of the sound being made by the instrument can be caused during the use of the instrument.

7. An instrument according to claim 5 wherein said body has a through cord opening at a location spaced from the outlet end of the bore a distance less than the minimum distance from the outlet end of the bore that the adjacent end of the baffle is placed in replicating the calls of the common loon, and the instrument includes a flexible cord having a portion extending through and filling said cord opening and extending out of said outlet end of said bore, said cord portion within said bore acting as a stop to prevent movement of said baffle past said cord portion and out of the outlet end of the bore.

8. An instrument according to claim 1 wherein said inner surface of said body is cylindrical and has a diameter in the range of 0.3 to 1.5 inch or 0.76 to 3.8 centimeters, and said bore has a length of at least 5 inches or 12.7 centimeters between said inlet and outlet ends.

9. A wind instrument for replicating the calls of birds or animals, said instrument comprising:

an elongate body having an outer surface, an inner surface defining a bore having an axis and opposite axially spaced inlet and outlet ends;

a mouthpiece at the inlet end of the body, said mouthpiece having a through windway smaller than said bore and having an inlet at the end of the mouthpiece opposite the bore and an outlet communicating with the bore at the inlet end of the bore adjacent the inner surface of the body;

said body having at least one window surface defining a window through said body between said outer and inner surfaces and aligned with the outlet of said windway, said window surface intersecting said inner surface to define a sharp edge at the side of the window opposite the mouthpiece so that air blown through the windway into the bore and the window will produce sound; and a baffle within said bore closing between 87 to 97 percent of the cross sectional area of said bore and being up to 0.83 inch or 2.11 centimeters long axially along said body, said baffle being fixed at a distance from said edge that affords significant changing of the pitch of the sound being made in response to changing air pressure blown through the instrument to replicate the call.

10. An instrument according to claim 9 particularly adapted to replicate the call of the common loon wherein said baffle is fixed at a distance from said edge that affords changing of the pitch of the sound being made between about 800 and 1090 cycles per second to replicate the wail call of the common loon in response to changing air pressure blown through the instrument.

11. An instrument according to claim 9 wherein said inner surface of said body is cylindrical and has a diameter of about 0.71 inches or 1.8 centimeters, and said baffle is spaced about 1.79 inches or 4.55 centimeters from said edge.

12. An instrument according to claim 1 wherein said outer surface of said body is cylindrical, said body is formed of a generally white colored polymeric material, and said cylindrical outer surface has black markings to replicate the appearance of birch bark.

13. An instrument according to claim 9 particularly adapted to replicate the bugling of elk wherein said baffle is fixed at a distance from said edge that affords significant changing of the pitch of the sound being made in response to a high pressure of air blown into the instrument from about 2000 cycles per second to a frequency in the range of about 2500 to 2700 cycles per second.

14. An instrument according to claim 9 wherein said baffle is fixed at a distance in the range of 0.28 inch to 2 inches or 0.71 centimeter to 5.08 centimeters from said edge at a position that affords significant changing of the pitch of the sound being made in response to different pressures of air blown through the instrument.

15. An instrument according to claim 2 wherein calls that involve producing sounds at different frequencies can be done by simply moving the baffle between the positions that make those sounds without the need to stop the call in order to reposition the baffle during different parts of the call.

* * * * *